US008141281B2

(12) United States Patent
Sample et al.

(10) Patent No.: US 8,141,281 B2
(45) Date of Patent: Mar. 27, 2012

(54) DISPLAY APPARATUSES

(76) Inventors: Joe M. Sample, Spokane, WA (US); Vincent J. De Felice, Spokane, WA (US)

( * ) Notice: Subject to any disclaimer, the term of this patent is extended or adjusted under 35 U.S.C. 154(b) by 0 days.

(21) Appl. No.: 12/838,293

(22) Filed: Jul. 16, 2010

(65) Prior Publication Data

US 2011/0072698 A1 Mar. 31, 2011

Related U.S. Application Data

(63) Continuation-in-part of application No. 29/310,110, filed on Jul. 24, 2008, and a continuation-in-part of application No. 29/315,167, filed on Jun. 2, 2009, now Pat. No. Des. 625,653, and a continuation-in-part of application No. 29/315,170, filed on Jun. 2, 2009, now Pat. No. Des. 622,630.

(51) Int. Cl.
*G09F 21/02* (2006.01)

(52) U.S. Cl. ..... 40/586; D2/615; D2/616; 446/327

(58) Field of Classification Search ..... 40/586; D2/615, 616; 446/327
See application file for complete search history.

(56) References Cited

U.S. PATENT DOCUMENTS

| | | | | |
|---|---|---|---|---|
| 1,118,488 | A | | 11/1914 | Homrig |
| D47,781 | S | | 9/1915 | Carson |
| 1,441,245 | A | | 1/1923 | Ryan et al. |
| D120,914 | S | | 6/1940 | Horther |
| D132,948 | S | | 7/1942 | Cooney |
| 2,453,604 | A | | 11/1948 | Tenenbaum et al. |
| 2,657,394 | A | | 11/1953 | Milton, Jr. et al. |
| D191,585 | S | | 10/1961 | Miller |
| D223,553 | S | | 5/1972 | Valverde |
| D234,583 | S | | 3/1975 | Ehrlich |
| D249,400 | S | | 9/1978 | Pearson |
| D258,860 | S | | 4/1981 | DiPietro |
| D260,626 | S | | 9/1981 | Kadar |
| D266,261 | S | | 9/1982 | Einhorn et al. |
| 4,352,461 | A | | 10/1982 | Orta et al. |
| 4,378,215 | A | | 3/1983 | Sparks |
| 4,486,975 | A | * | 12/1984 | Harreld et al. ..... 446/220 |
| D288,076 | S | | 2/1987 | Wheeler |
| D295,640 | S | | 5/1988 | Breault |
| D298,686 | S | | 11/1988 | Colclasure |
| 4,850,052 | A | * | 7/1989 | Matthews ..... 2/160 |
| D303,036 | S | | 8/1989 | Giles |
| D311,267 | S | | 10/1990 | Pesta |
| D313,496 | S | | 1/1991 | Pesta |
| D315,528 | S | | 3/1991 | Nickolett |

(Continued)

OTHER PUBLICATIONS http://www.licensingoutlook.com/show-2009/day1-09-photos.html, "Day 1 Photos" from Jan. 21, 2009; Sports Licensing and Tailgate Show in Las Vegas, NV; 3 pps.

(Continued)

*Primary Examiner* — Gary Hoge
(74) *Attorney, Agent, or Firm* — Parsons Behle & Latimer

(57) ABSTRACT

An apparatus includes a display body having a three-dimensionally contoured exterior shape and an interior, hand-receiving cavity extending within the display body. An optional display cover may be mounted on a selected portion of the display body or included in an unassembled kit. The display cover bears a communication attribute and is configured for repeated removal from and replacement on the display body. The apparatus may be configured for use by a person as a hand-mounted display.

23 Claims, 9 Drawing Sheets

U.S. PATENT DOCUMENTS

| | | | | | |
|---|---|---|---|---|---|
| D324,083 | S | | 2/1992 | Gelen | |
| D326,122 | S | | 5/1992 | Wilson | |
| D339,380 | S | | 9/1993 | Scapillato | |
| D339,609 | S | | 9/1993 | Martin et al. | |
| 5,343,567 | A | | 9/1994 | Zumbiel | |
| 5,369,257 | A | * | 11/1994 | Gibbon | 219/759 |
| 5,457,821 | A | | 10/1995 | Kiefer | |
| D377,053 | S | | 12/1996 | Williams | |
| 5,592,953 | A | * | 1/1997 | Delao | 128/882 |
| D386,530 | S | | 11/1997 | Pesta | |
| D387,542 | S | | 12/1997 | Smith | |
| D393,345 | S | | 4/1998 | Clegg et al. | |
| D393,535 | S | | 4/1998 | Farber | |
| D397,540 | S | | 9/1998 | Chase | |
| D397,740 | S | | 9/1998 | Georgevich | |
| D406,437 | S | | 3/1999 | Tulleners | |
| D416,055 | S | | 11/1999 | Pool et al. | |
| D417,728 | S | | 12/1999 | Benton | |
| D417,769 | S | | 12/1999 | Cauthen | |
| 6,012,174 | A | | 1/2000 | Rech et al. | |
| D420,206 | S | | 2/2000 | Lawson | |
| D420,494 | S | | 2/2000 | Eschbacher et al. | |
| D429,285 | S | | 8/2000 | Schini | |
| 6,108,817 | A | | 8/2000 | Kostelac | |
| D435,957 | S | | 1/2001 | Kenefake | |
| D462,507 | S | | 9/2002 | Bishop et al. | |
| 6,472,590 | B1 | * | 10/2002 | Kulik | 84/453 |
| D466,353 | S | | 12/2002 | Marks et al. | |
| 6,612,056 | B1 | * | 9/2003 | Thomas, II | 40/586 |
| D489,772 | S | | 5/2004 | Fine et al. | |
| D495,749 | S | | 9/2004 | Van Veen et al. | |
| D506,569 | S | | 6/2005 | Chen | |
| D512,811 | S | | 12/2005 | Luciano et al. | |
| D531,859 | S | | 11/2006 | Bogumil et al. | |
| D536,156 | S | * | 2/2007 | McSweeney | D2/615 |
| D543,789 | S | | 6/2007 | Gilley et al. | |
| D558,273 | S | | 12/2007 | Keith | |
| D567,476 | S | | 4/2008 | Harland | |
| D585,260 | S | * | 1/2009 | Smith et al. | D8/75 |
| 7,530,876 | B1 | * | 5/2009 | Wimberly | 446/327 |

OTHER PUBLICATIONS

Pointing finger on white—iStockPhoto.com image uploaded on May 23, 2005; pulled from the web Jun. 28, 2010 http://www.istockphoto.com/file_closeup/people/605934-pointing-finger-on-white.php?id=605934&refnum=193954.

* cited by examiner

DISPLAY APPARATUSES

RELATED APPLICATION DATA

This application is a continuation-in-part of U.S. patent application Ser. No. 29/310,110 filed Jul. 24, 2008, U.S. patent application Ser. No. 29/315,167 filed Jun. 2, 2009, and U.S. patent application Ser. No. 29/315,170 filed Jun. 2, 2009, which are incorporated herein by reference.

TECHNICAL FIELD

The embodiments herein pertain to display apparatuses including, but not limited to, hand-held apparatuses with display covers.

BACKGROUND OF THE INVENTION

Sports fans and other people use handheld signs to display messages, team names, team logos, or other indicators. They are used at sports activities, political rallies, demonstrations of political causes, or other activities to show support for a team, organization, or cause.

Some known handheld displays are formed as flat signs of paper, plastic, flexible foam sheets, rigid foam boards, and other materials. Known flexible foam signs may be flat and use one or more layers of foam. Layers of foam may be adhered or otherwise joined together about the periphery of the flat sign. Some signs include a slit or gap between foam sheets into which the hand may be inserted. Known shapes include rough emulations of a hand forming a hand gesture and communicating a message. A wearer typically waves the foam sign during sports events or at other activities for fun or to show support.

BRIEF DESCRIPTION OF THE DRAWINGS

Preferred embodiments of the invention are described below with reference to the following accompanying drawings.

FIG. 9 is a diagrammatic view indicating how the display cover of FIGS. 3-5 is installed to form the display apparatus of FIG. 1.

DETAILED DESCRIPTION OF THE PREFERRED EMBODIMENTS

Figure 1:
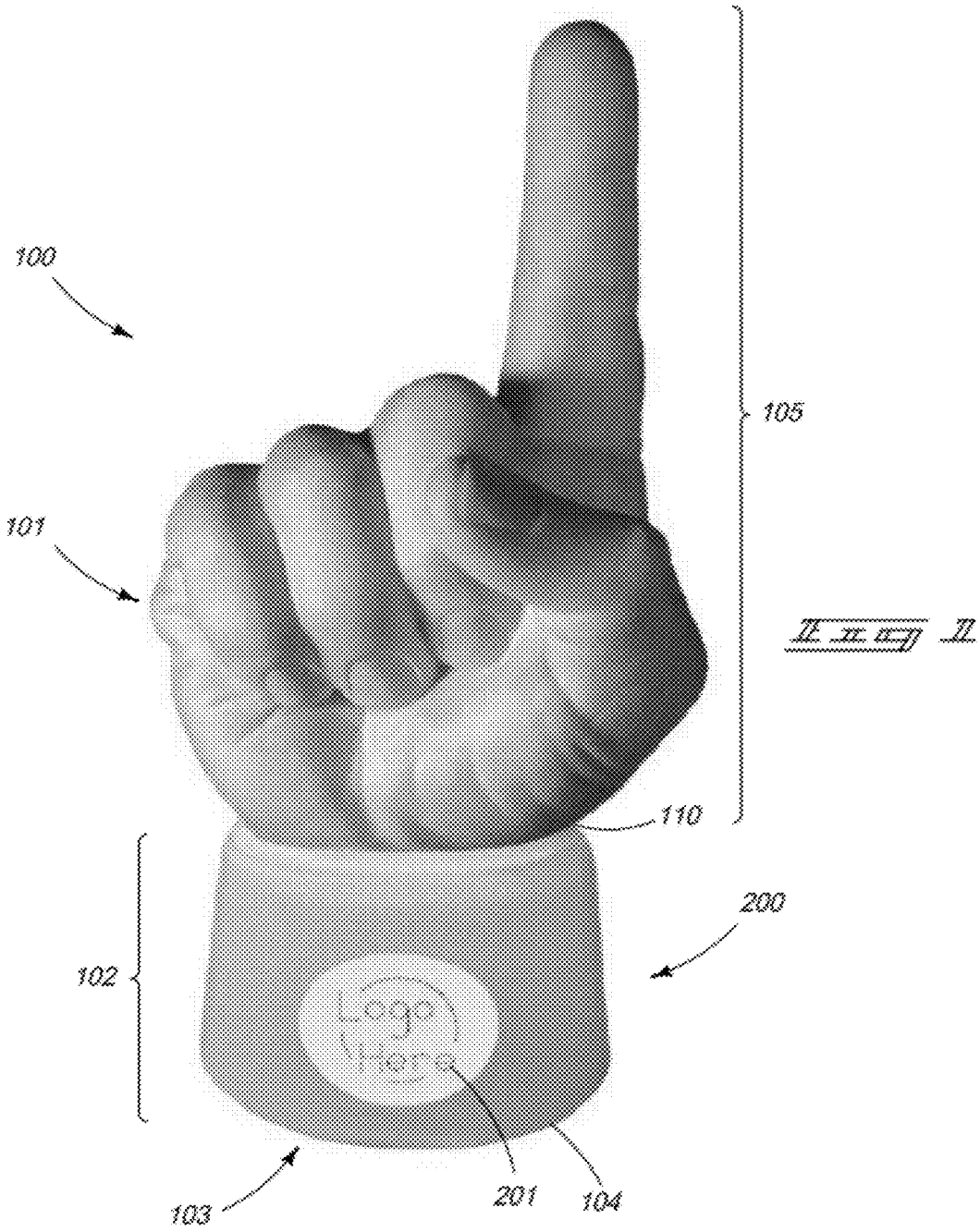
FIGS. 1 and 2 are respective front and rear perspective views of a display apparatus.

As FIG. 1 shows, the embodiments herein include hand-mountable display apparatuses, such as display apparatus 100 or other suitable display shapes that may be worn on a user's hand. Apparatus 100 includes a display body 101 and a display cover 200. A display body may be made in various colors, as well as different shapes and contours. A display cover may be made in various types with various communication attributes. Thus, a display apparatus may be made to have an essentially unlimited variety of appearances by using different colors, exterior shapes, and communication attributes for the display body and/or display cover. One benefit of embodiments described herein includes interchangeability of display covers.

The display body may have a three-dimensionally contoured exterior shape. Display body 101 includes an upper section 105 and a lower section 102. Upper section 105 may be an attention getting shape, such as a hand forming a communication gesture. As shown, the contoured exterior shape includes a hand forming a fist with an extended index finger. Commonly, such gesture may communicate a "we're number 1" message.

Upper section 105 may include other abstractions of a human hand making various gestures. Examples include the gestures shown in the related applications listed above and incorporated herein by reference. A hand forming a fist with an extended index finger and middle finger, which are spread apart, may communicate a "peace" or "victory" message. A hand forming a fist with an extended index finger and little finger may communicate a "hook'em horns" message. Still other shapes, including non-hand shapes, may be suitable.

Lower section 102 may be selected as a portion of display body 101 for mounting a display cover 200. A shoulder 110 of lower section 102 may be provided at a transition between upper and lower sections 105/102 to function as a mounting feature. A mounting feature may engage some part of a display cover, such as a cinch or other part, which functions to retain the display cover on a display body. In the particular embodiment of FIG. 1, shoulder 110 adds to the appearance of lower section 102 as representing a wrist band. Alternative mounting features include a channel or other shapes. The mounting feature may be circumferential, extending around the full circumference of lower section 102, or extend only partially around lower section 102.

Consequently, in one embodiment an apparatus includes a display body having a three-dimensionally contoured exterior shape and an interior, hand-receiving cavity extending within the display body. A display cover is mounted only on a selected portion of the display body, the display cover bearing a communication attribute and being configured for repeated removal from and replacement on the display body. The apparatus is configured for use by a person as a hand-mounted display.

By way of example, the interior cavity may have a top, a bottom, and a tapered sidewall extending from the top to the bottom. Also, the bottom may exhibit a diameter greater than a diameter of the top. A hand-receiving entrance into the interior cavity may be provided through the bottom of the selected portion of the display body whereon the display cover is mounted. The selected portion may represent a wrist band including a top, a bottom, and a tapered sidewall extending from the top to the bottom, the bottom exhibiting a diameter greater than a diameter of the top and forming a base on which the apparatus may rest in an upright position. The apparatus may rest on the base in the upright position without any other support.

Figure 10:
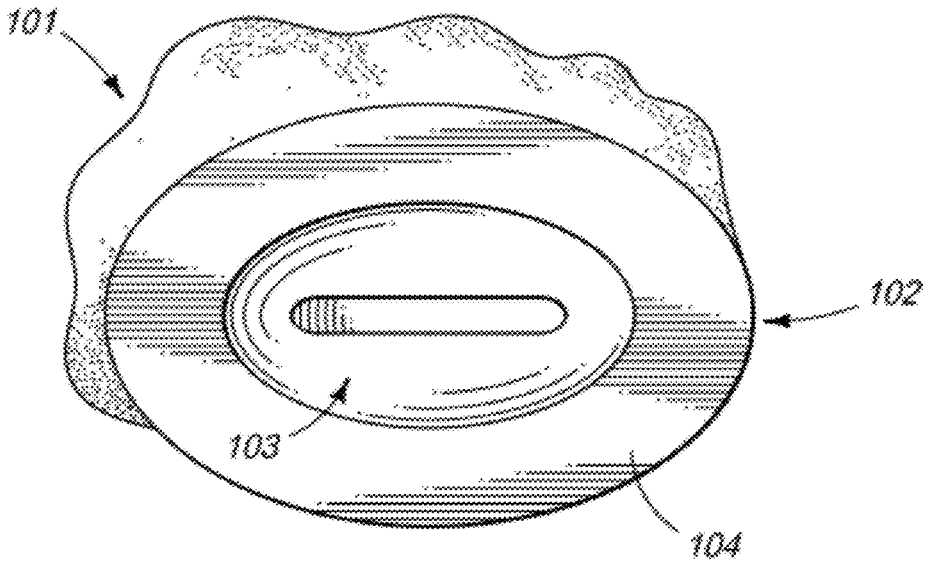
FIG. 10 is a bottom view of the display body of FIG. 1 without the display cover.
Figure 11:
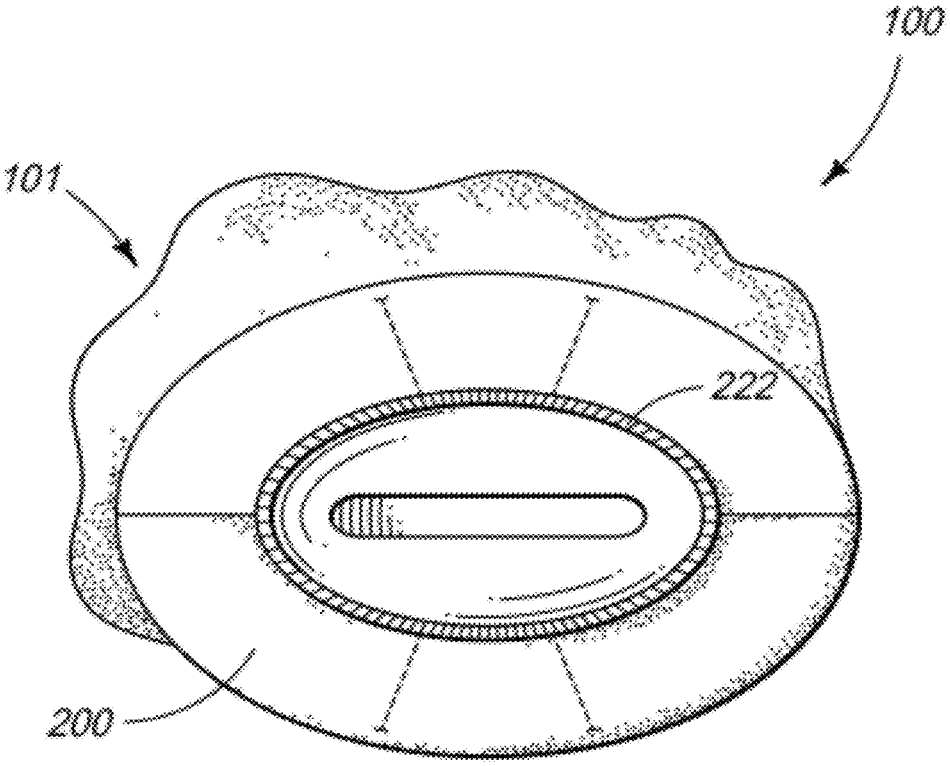
FIG. 11 is a bottom view of the display apparatus of FIG. 1.

Display body 101 has an interior cavity 103 shown in FIGS. 10-13. FIG. 10 shows cavity 103 without a display cover installed on display body 101. FIG. 11 shows the same view as FIG. 10 but with display cover 200 installed. Cavity 103 allows insertion of a user's hand for hand mounting of apparatus 100. FIGS. 10-13 show that a bottom of cavity 103 at the hand-receiving entrance at a bottom 104 of lower section 102 exhibits a diameter greater than a top of cavity 103 in upper section 105. The sidewall between the top and bottom is tapered. Also, the top and bottom of cavity 103 both exhibit an oval circumference in a lateral (or horizontal) cross-section.

The tapered sidewall of cavity 103 increases the stability of hand mounting and allows for a range of hand sizes and shapes. The oval circumferences of the top and bottom of cavity 103 enable flat-handed insertion of a user's hand, which reduces hand fatigue compared to other hand positions. The combination of the tapered sidewall and oval circumferences allows insertion of a user's hand to a point where the fit becomes snug but, even though the fit is snug, the flat-handed position allows comfort.

A small hand might be inserted fully to the top of cavity 103, while a large hand might be inserted only partially. Regardless, the snug, flat-handed fit provides ease in control of display body 101 when hand-mounted, even during exciting or intense moments of a sports game, rally, protest, other event. Such a fit keeps display body 101 from falling off unintentionally. Because the snug fit is comfortable, display body 101 may be worn for long periods of time, encouraging its use.

Figure 12:
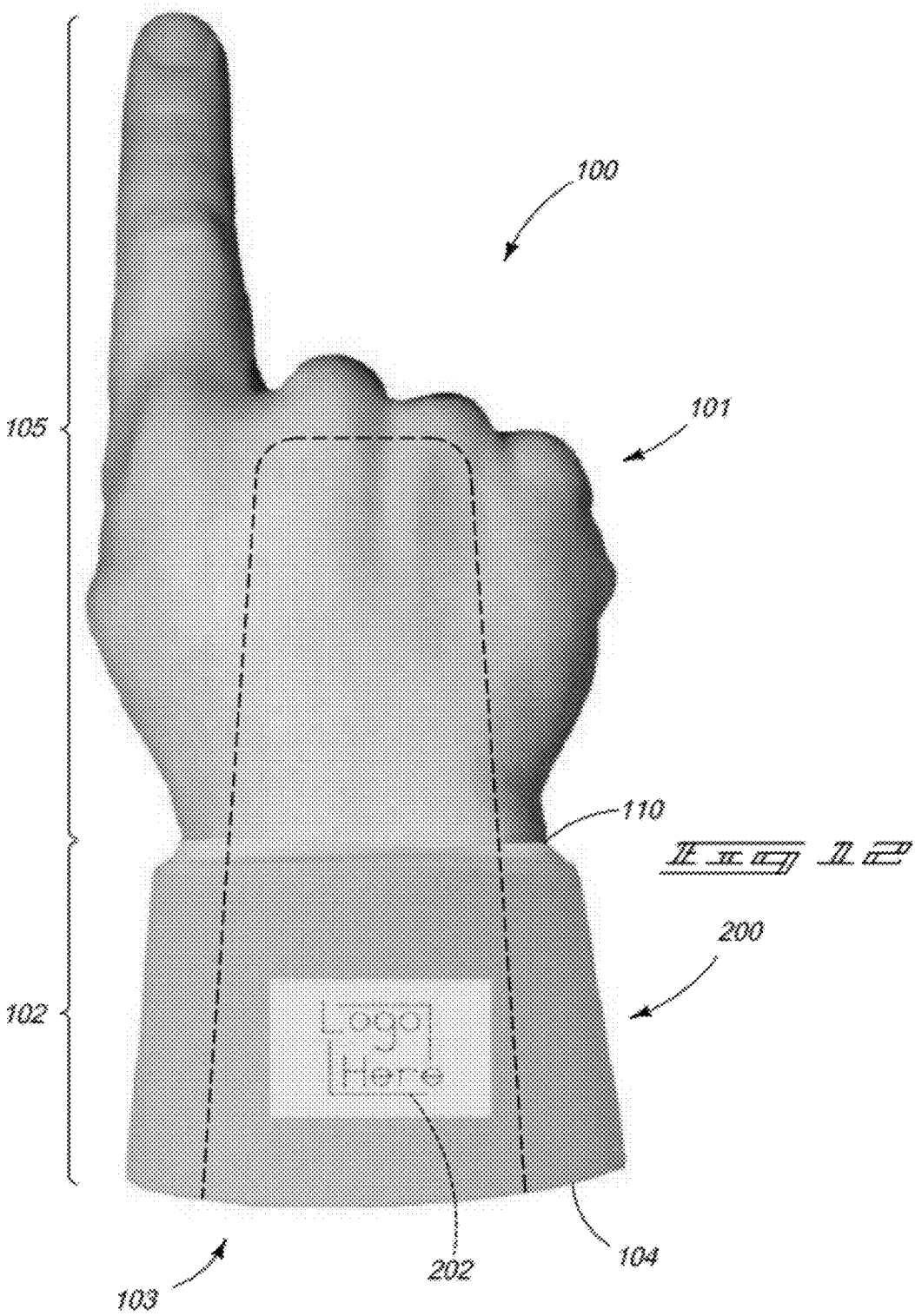
FIGS. 12 and 13 are respective rear and side views of the display apparatus of FIG. 1 with hidden lines showing an interior cavity. The display cover is removed in FIG. 13.
Figure 13:
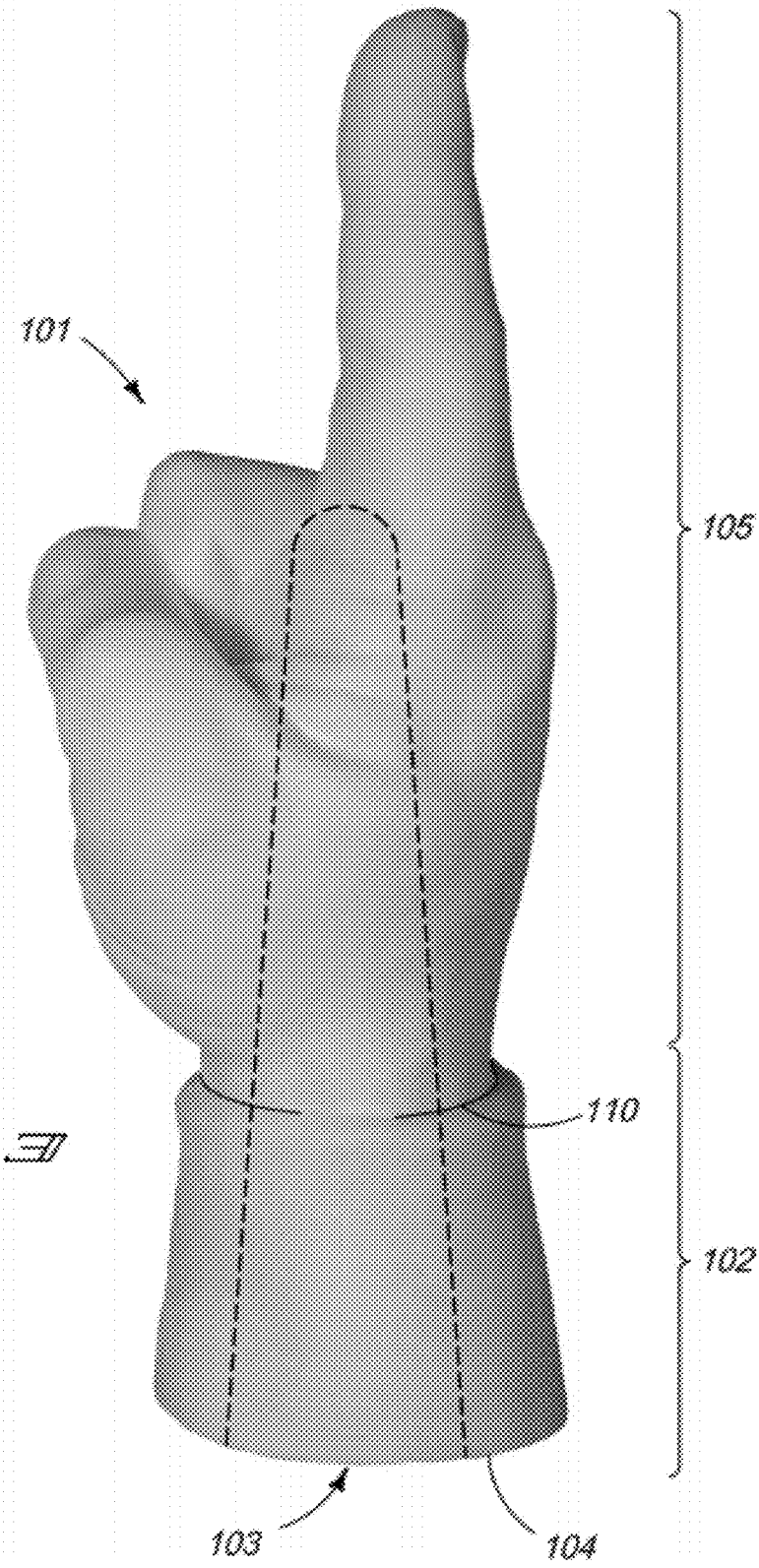

The taper of cavity 103 may be referred to as a double taper since cavity 103 tapers from a width and height of the hand-receiving entrance shown in FIG. 10 along a length of the cavity shown in FIGS. 12 and 13 to a smaller width and height of the top of cavity 103. Tapering occurs both in the width and the height directions. It is conceivable that tapering only in the height direction of cavity 103 shown in FIG. 10 may provide some, but not all, of the benefits described above for a snug, flat-handed fit. Additionally tapering in the width direction may increase snugness.

Lower section 102 is adapted to allow a display cover, such as display cover 200, to be fitted thereon so as to reduce display cover movement relative to display body 101 during normal use. FIGS. 1, 2, 11, and 12 show display body 101 with display cover 200 mounted thereon. A display cover might be mounted only on lower section 102. Alternatively, a display cover may be mounted on other sections of a display body, perhaps even on an entirety of a display body. Lower section 102 in FIGS. 1, 2, 12, and 13 exhibits an oval circumference in a lateral (or horizontal) cross-section. Other cross-sectional shapes may be suitable, depending on the structure of upper section 105.

Lower section 102 is shown to include a top, a bottom, and a tapered sidewall extending from the top to the bottom, the bottom exhibiting a diameter greater than a diameter of the top and forming a base on which the apparatus may rest in an upright position. Such tapering or other tapering also may aid in retaining a display cover the section 102. Tapering may be linear or of other shapes consistent with the descriptions herein of other features. Lower section 102 may be double tapered as described above for cavity 103. In FIGS. 12-13, the taper of lower section 102 is shown as similar to the taper of cavity 103. Such tapers may be matched so that a constant thickness exists between the sidewall of lower section 102 and the sidewall of cavity 103. Notably, in FIG. 9, lower section 102 is not shown as being tapered and such untapered structures, such as cylindrical structures, are encompassed by the various embodiments herein.

By way of example, a display cover may include at least one cinch that engages the display cover with a display body. The at least one cinch may be in the form of at least one elastic band. Accordingly, the display cover may include a top end, a bottom end, a top cinch at the top end, and a bottom cinch at the bottom end. The top and bottom cinches may both include elastic bands.

The display cover may contain a sleeve including a flexible material. The flexible material may be a stretchable fabric. Furthermore, the sleeve may exhibit sufficient elasticity to conform to and to be retained on the selected portion of the display body. That is, the properties of the sleeve may be adequate for retention even absent any cinches. Nevertheless, cinches may be included in the sleeve for increased engagement with the display body. Also, elasticity of the sleeve may be enhanced with elastic cinches, as above.

A communication attribute of a display cover or a display body may be affiliated with an organization. The communication attribute may include at least one attribute selected from the group consisting of color, lettering, words, phrases, logos, ornamentation, and combinations thereof. Logos are considered to further include a variety of designations, such as trademarks, designs, emblems, insignia, etc. The communication attribute may include at least one logo and color of a sports team. Thereby, a color of the display cover may match a color of the sports team, with the team logo applied to the display cover. If the display body includes a hand and a wrist band and the display cover is mounted on the wrist band, then the mounted display cover may give the impression of a wrist band as might be worn by a participating athlete. An alternative impression may be that the display cover represents a team jersey. Since the display body may be colored, it may match another color of a sports team in the circumstance where the team has two colors. As may be appreciated, the communication attribute, such as a logo, may be applied directly to a selected portion of the display body, for example, on a wrist band, instead of or in addition to a display cover.

Figure 2:
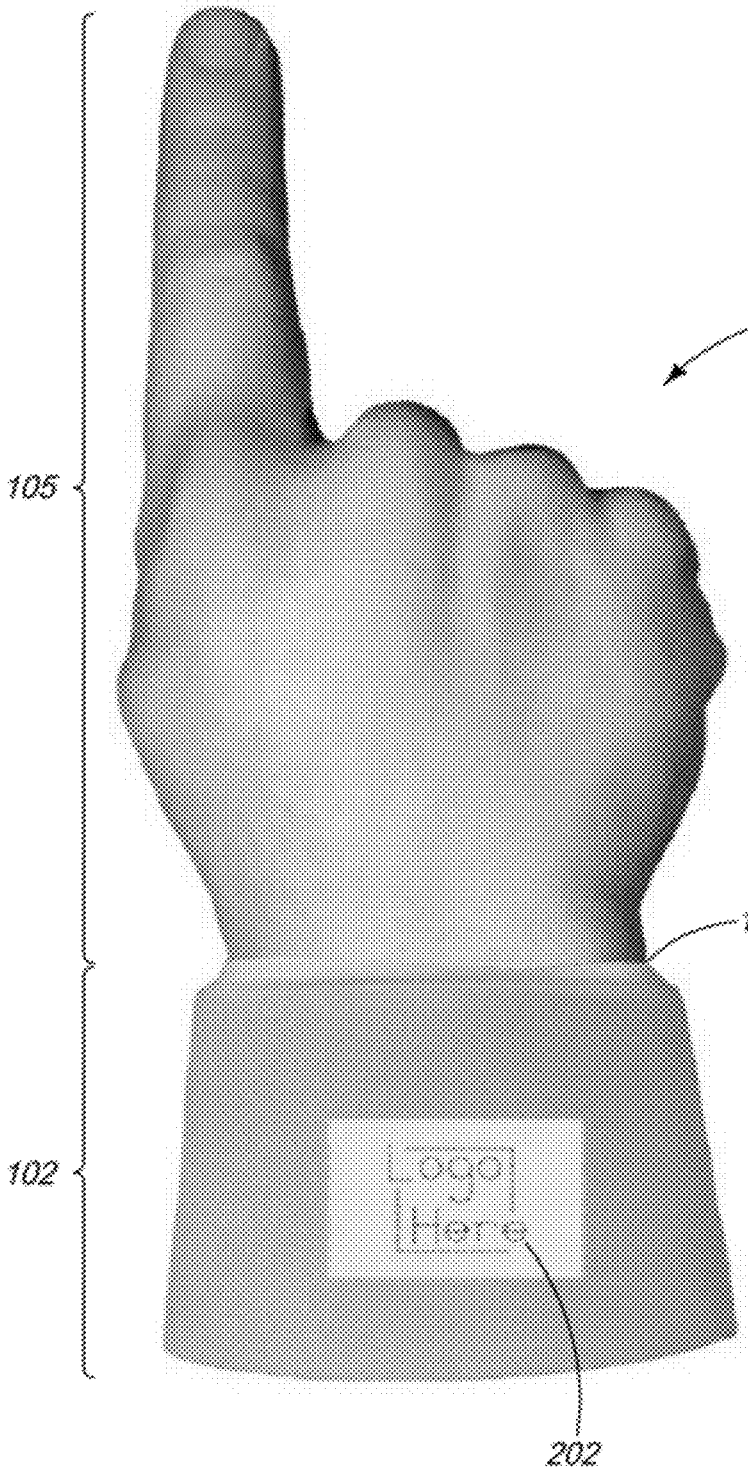
Figure 3:
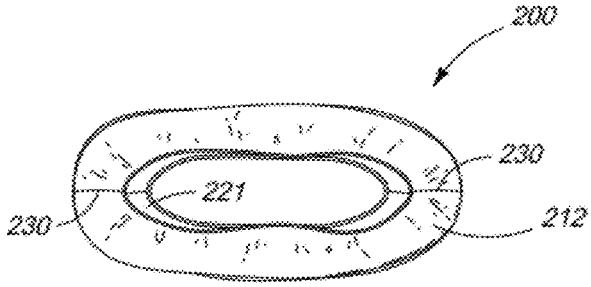
FIGS. 3-5 are respective top, front, and rear views of a flexible display cover used in the display apparatus of FIG. 1 shown removed from the apparatus.
Figure 4:
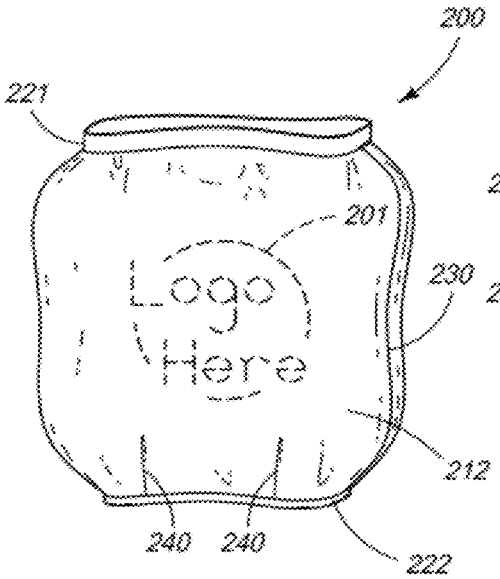
Figure 5:
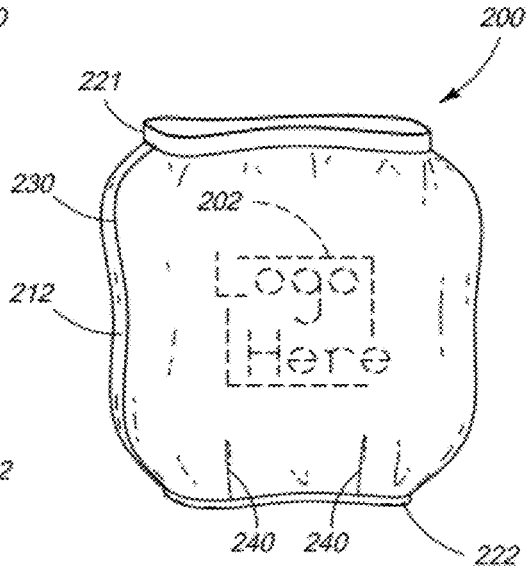

FIGS. 1 and 2 show apparatus 100 using display cover 200 having a front logo 201 and a back logo 202 (shown with dashed lines). FIGS. 3-5 show display cover 200 in isolation. Display cover 200 is shaped and constructed in a manner that allows it to conform to lower section 102 of display body 101. Also, lower section 102 is constructed and configured to retain in place one or more of display cover 200.

FIGS. 3-5 show display cover 200 as a sleeve including two panels of fabric sewn together at curved side seams 230 and having pleats 240 at the bottom. Side seams 230 and pleats 240 both contribute to conforming to a contoured shape, such as lower section 102. For example, as further shown in FIG. 11, pleats 240 correspond with a transition from the sidewall to the bottom of lower section 102. Fabric properties, such as elasticity, may further be selected to assist display cover 200 in conforming to lower section 102.

Thus, display cover 200 may include one or more pieces that form a sidewall 212. Sidewall 212 may be attached to top cinch 221 and bottom cinch 222, which may be made from strips of elastic material and thus be capable of expanding during installation and contracting after installation. Such elastic material may be selected from several different types.

For example, as shown, top cinch 221 may be a comparatively wide strip and represent a collar on a team jersey with sidewall 212 sewn to the bottom of the strip. Bottom cinch 222, as shown, may be a comparatively narrow strip attached to the edge of sidewall 212 within a finishing overstitch. Bottom cinch 222 may be slideably contained within the overstitch, without piercing the strip of elastic material, so that the bottom of sidewall 212 expands and contracts easily. Cinches may be provided in various colors that either match or contrast with upper section 105 and/or sidewall 212 to provide communication attributes or otherwise enhance the appearance of display apparatus 100, depending on its particular intended use.

Cinches 221 and 222 help engage display cover 200 with display body 101. Although elastic cinches may be used, other forms of cinches may additionally be suitable. It may also be possible to have only one cinch, such as either top cinch 221 or bottom cinch 222 in some alternative forms of display covers. Top cinch 221 and bottom cinch 222 are at respective top and bottom ends of display cover 200. It is conceivable that cinches may be provided at alternative locations to engage display cover 200 with display body 101.

The cinches may be made so that their expanded size allows installation of the display cover onto a given shape and size of a portion of the display body selected for mounting, while still providing adequate retention. That is, cinches may be of different or same lengths, depending on display body structure and/or display cover placement. As illustrated, when the display cover is removed from the display body, the top and bottom ends may exhibit inner diameters less than an inner diameter of the sidewall between the top and bottom ends. Accordingly, the sidewall of the display cover may also be shaped and sized to accommodate the structure of a given display body, such as oval, circular, or another cross-sectional shape.

Figure 6:
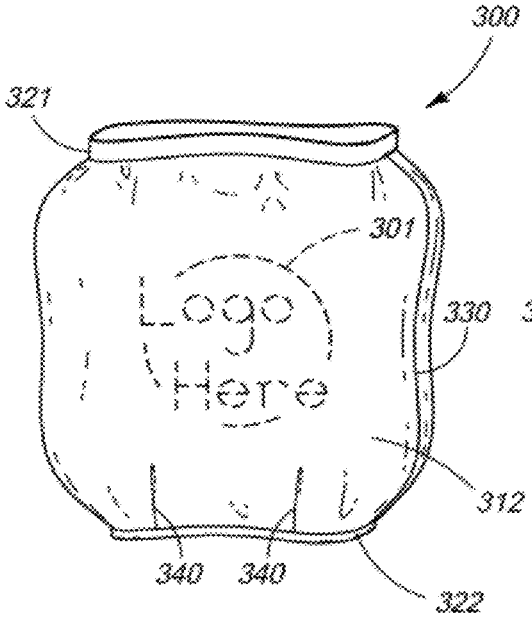
FIGS. 6-8 are respective front, rear, and bottom views of an alternate flexible display cover shown in isolation.
Figure 7:
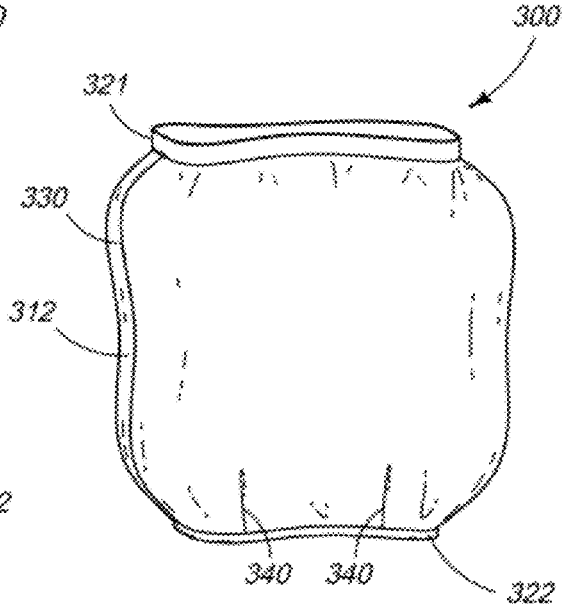
Figure 8:
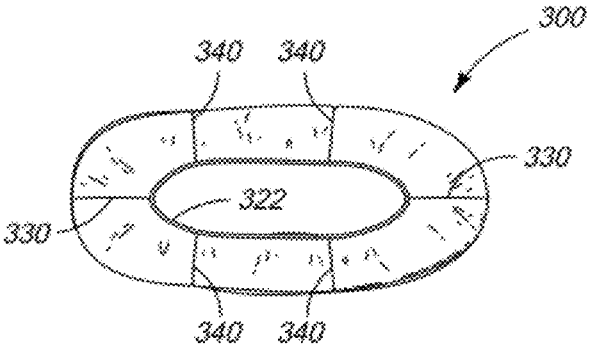
Figure 5:
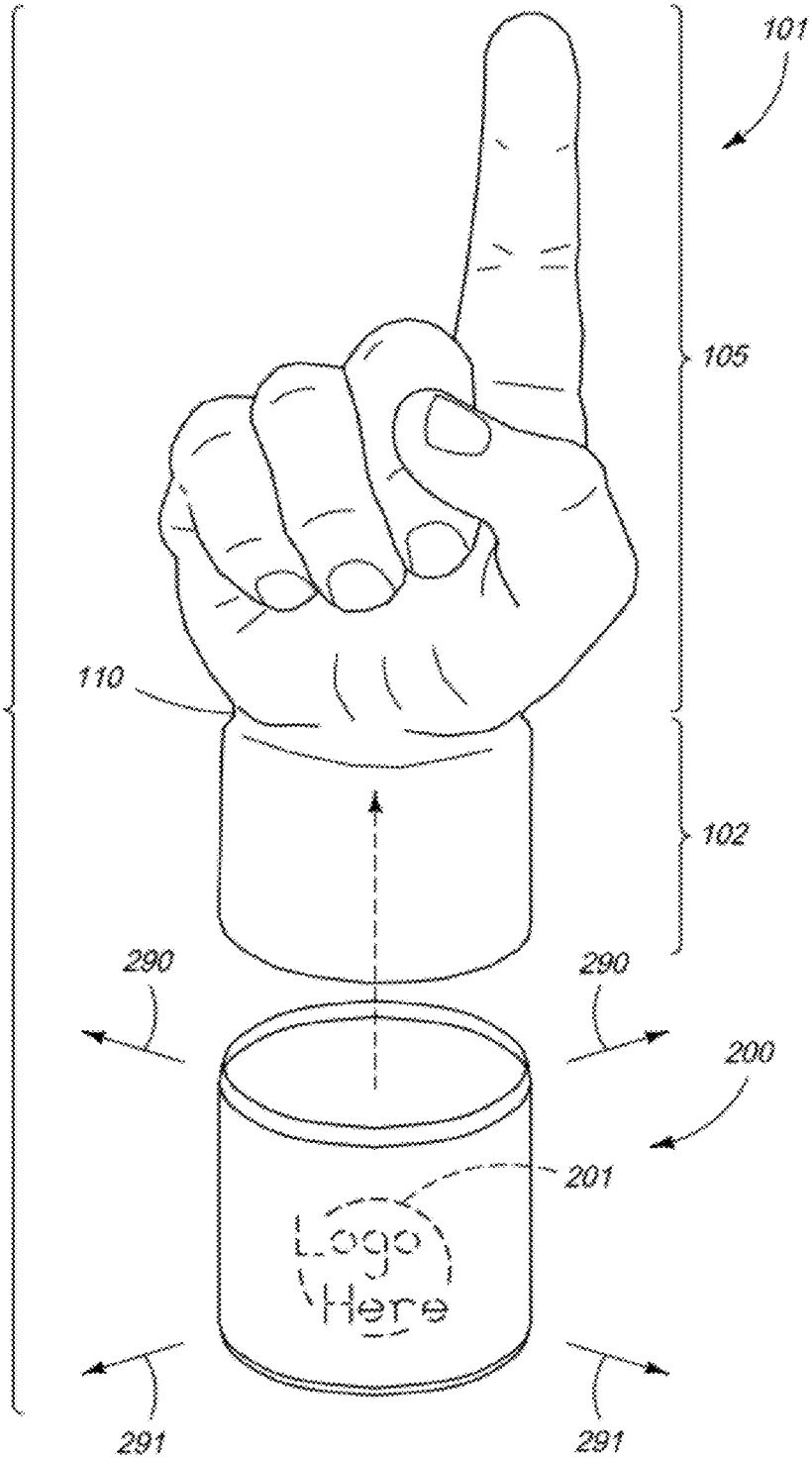

FIGS. 6-8 show an alternative display cover 300. Display cover 300 is constructed similar to display cover 200. Like features of display cover 300 are numbered in the 300's series instead of the 200's series, as in FIGS. 3-5. The only difference of display cover 300 is that it has only one logo 301 on the front side and no logo on the back side. Logo 301 may be the same or different from logos 201 and 202. The color of sidewall 212 and/or cinches 221/222 may be the same or different from sidewall 312 and/or cinches 321/322. FIG. 8 additionally shows the bottom of display cover 300, which is the same as the bottom (not shown) of display cover 200.

As display covers 200 and 300 demonstrate, it is possible to provide multiple display covers bearing different communication attributes for a given display body. Consequently, repeated removal from and replacement on a display body may be a desirable feature of display covers to allow use of a single display body in multiple settings or activities merely by interchanging display covers. Interchangeability of display covers provides a significant benefit to owners of a display body.

A display body, such as one including upper and lower sections 105 and 102, may be formed as a single piece, for example, in a single mold. Alternatively, separated parts could be made and then heat welded, adhered, or otherwise joined. When molded as a single piece, interior cavity 103 may be provided by using a mold extension, creating an open space for cavity 103 upon release of the mold. Other cavity-creating techniques may be used. Suitable materials for the display body may vary as desired. Light weight and durability may be significant considerations. Polyurethane foam, polypropylene foam, polystyrene foam, foam rubber, other foam materials, and perhaps other non-foam materials may be suitable.

The display cover may be produced in a typical fashion suitable to produce garments. Nylon, polyester, polypropylene, and various other fabrics may be suitable. The display covers may instead or additionally be made of a flexible membrane material, such as various polymer sheets. SPANDEX™ reinforced fabrics or similar elastic fabric or materials may be used. The fabric or material may be thin, as shown in the Figures, or thick, adding shaped features to the display apparatus upon installation on the display body. Since the display cover may be produced like a garment, logos and other communication attributes can be provided or applied in a suitable manner at reasonable cost in production machinery developed for applying decals, designs, screen printing, embroidery, or other features.

Installation of the display cover is shown diagrammatically in FIG. 9. During installation the top cinch is expanded manually or otherwise, as indicated by arrows 290 at the top of display cover 200. Display cover 200 is then positioned over lower section 102 and the top cinch secured where appropriate, such as at shoulder 110. For a suitably-sized, elastic top cinch, securing may be automatic upon release of the top cinch. For other cinches, addition securing steps may be used. Depending on the structure of lower section 102 and display cover 200, expansion in the direction shown by arrows 291 might not be applied. As shown in FIG. 11, bottom cinch 222 functions primarily to conform display cover 200 to lower section 102 and need only be expanded slightly, if at all, for installation. Removal of the display cover may be accomplished by reversing the installation steps.

As a further benefit, the display body may function as a glove, hand warmer, or other hand protector and may be provided in pairs for both hands. If used as a protector for the hands, then a bottom cinch, such as bottom cinch 222, of the display cover may be configured to function further as an air barrier for the interior cavity sealed around a users arm. This may be appealing when used in cold weather. Some sports such as football, hockey, ice skating, and others may thus be rendered more comfortable for the users of the embodiments herein.

According to an embodiment, an apparatus includes a display body having a three-dimensionally contoured exterior shape containing a hand and a wrist band, the hand forming a communication gesture. An interior, hand-receiving cavity extends within the display body. A display cover is mounted on the wrist band, the display cover including at least one cinch and a sleeve. The cinch engages the display cover with the display body and the sleeve includes a flexible material exhibiting sufficient elasticity to conform to the wrist band. The display cover is configured for repeated removal from and replacement on the display body.

According to another embodiment, an apparatus includes a display body having a three-dimensionally contoured exterior shape containing a hand and a wrist band, the hand forming a fist with an extended index finger. The wrist band has a top, a bottom, and a tapered sidewall extending from the top to the bottom. The bottom exhibits a diameter greater than a diameter of the top and forms a base on which the apparatus may rest in an upright position. An interior, hand-receiving cavity extends within the display body, the interior cavity having a top, a bottom, and a tapered sidewall extending from the top to the bottom, the bottom exhibiting a diameter greater than a diameter of the top. A hand-receiving entrance into the interior cavity is through the bottom of the wrist band. A display cover is mounted on the wrist band, the display cover including a sleeve containing a flexible fabric and bearing at least one logo. The sleeve exhibits sufficient elasticity to conform to and to be retained on the wrist band.

According to a further embodiment, an apparatus includes a display body having a three-dimensionally contoured exterior shape containing a hand and a wrist band, the hand forming a fist with an extended index finger. The wrist band has a top, a bottom, and a sidewall extending from the top to the bottom, the top of the wrist band forming a circumferential shoulder at a transition between the wrist band and the hand. An interior, hand-receiving cavity extends within the display body, the interior cavity having a top, a bottom, and a tapered sidewall extending from the top to the bottom, the bottom exhibiting a diameter greater than a diameter of the top. A hand-receiving entrance into the interior cavity is through the bottom of the wrist band.

By way of example, the wrist band sidewall may include a tapered sidewall. Also, the display body may be comprised by an unassembled kit further containing at least one display cover. The display cover may bear a communication attribute and be sized for mounting on a selected portion of the display body. Multiple display covers bearing different communication attributes may be included in the kit.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. An apparatus comprising:

a display body having a three-dimensionally contoured exterior shape;

an interior, hand-receiving cavity extending within the display body;

a display cover mounted only on a selected portion of the display body, the display cover bearing a communication attribute, being configured for repeated removal from and replacement on the display body, and comprising a sleeve including a flexible material; and the apparatus being configured for use by a person as a hand-mounted display.

2. The apparatus of claim 1 wherein the exterior shape of the display body comprises a hand and a wrist band, the hand forming a communication gesture and the display cover being mounted on the wrist band.

3. The apparatus of claim 2 wherein the wrist band comprises a top, a bottom, and a tapered sidewall extending from the top to the bottom, the bottom exhibiting a diameter greater than a diameter of the top and forming a base on which the apparatus may rest in an upright position.

4. The apparatus of claim 3 wherein the interior cavity comprises a top, a bottom, and a tapered sidewall extending from the top to the bottom, the bottom exhibiting a diameter greater than a diameter of the top and a hand-receiving entrance into the interior cavity being through the bottom of the wrist band.

5. The apparatus of claim 1 wherein the interior cavity comprises a top and a bottom and a tapered sidewall extending from the top to the bottom, the bottom exhibiting a diameter greater than a diameter of the top.

6. The apparatus of claim 1 wherein the exterior shape of the display body comprises a hand forming a first with an extended index finger.

7. The apparatus of claim 1 wherein the display cover comprises at least one cinch that engages the display cover with the display body.

8. The apparatus of claim 1 wherein the display cover comprises a top end, a bottom end, a top cinch at the top end, and a bottom cinch at the bottom end, the top and bottom cinches including elastic bands and retaining the display cover on the selected portion of the display body.

9. The apparatus of claim 1 wherein the display cover comprises a sleeve including a flexible fabric, the sleeve exhibiting sufficient elasticity to conform to and to be retained on the selected portion of the display body.

10. The apparatus of claim 1 wherein the communication attribute is affiliated with an organization and comprises at least one attribute selected from the group consisting of color, lettering, words, phrases, logos, ornamentation, and combinations thereof.

11. The apparatus of claim 1 wherein the communication attribute comprises at least one logo and color of a sports team.

12. An apparatus comprising:

a display body having a three-dimensionally contoured exterior shape including a hand and a wrist band, the hand forming a communication gesture;

an interior, hand-receiving cavity extending within the display body;

a display cover mounted on the wrist band, the display cover including at least one cinch and a sleeve, the cinch engaging the display cover with the display body and the sleeve including a flexible material exhibiting sufficient elasticity to conform to the wrist band, the display cover being configured for repeated removal from and replacement on the display body; and the apparatus being configured for use by a person as a hand-mounted display.

13. The apparatus of claim 12 wherein the display body includes a mounting feature, the cinch being engaged with the mounting feature.

14. The apparatus of claim 12 wherein the wrist band comprises a top, a bottom, and a tapered sidewall extending from the top to the bottom, the bottom exhibiting a diameter greater than a diameter of the top and forming a base on which the apparatus may rest in an upright position.

15. The apparatus of claim 12 wherein the interior cavity comprises a top, a bottom, and a tapered sidewall extending from the top to the bottom, the bottom exhibiting a diameter greater than a diameter of the top and a hand-receiving entrance into the interior cavity being through the wrist band.

16. The apparatus of claim 12 wherein the hand forms a first with an extended index finger.

17. The apparatus of claim 12 wherein the display cover comprises a top end and a bottom end and the at least one cinch comprises a top cinch at the top end and a bottom cinch at the bottom end.

18. An apparatus comprising:

a display body having a three-dimensionally contoured exterior shape including a hand and a wrist band, the hand forming a first with an extended index finger, the wrist band having a top, a bottom, and a tapered sidewall extending from the top to the bottom, and the bottom exhibiting a diameter greater than a diameter of the top and forming a base on which the apparatus may rest in an upright position;

an interior, hand-receiving cavity extending within the display body, the interior cavity having a top, a bottom, and a tapered sidewall extending from the top to the bottom, the bottom exhibiting a diameter greater than a diameter of the top, and a hand-receiving entrance into the interior cavity being through the bottom of the wrist band; and a display cover mounted on the wrist band, the display cover including a sleeve containing a flexible fabric and bearing at least one logo, the sleeve exhibiting sufficient elasticity to conform to and to be retained on the wrist band, and the display cover being configured for repeated removal from and replacement on the display body.

19. The apparatus of claim 18 wherein the display cover comprises at least one cinch including at least one elastic band that engages the display cover with the display body.

20. The apparatus of claim 19 wherein the top of the wrist band forms a circumferential shoulder at a transition between the wrist band and the hand, the cinch being engaged with the shoulder.

21. The apparatus of claim 18 wherein the display cover has a top end and a bottom end and, when the display cover is removed from the display body, the top and bottom ends exhibit inner diameters less than an inner diameter of the sleeve between the top and bottom ends.

22. An apparatus comprising:

a display body having a three-dimensionally contoured exterior shape including a hand and a wrist band, the hand forming a first with an extended index finger, the wrist band having a top, a bottom, and a sidewall extending from the top to the bottom, the top of the wrist band forming a circumferential shoulder at a transition between the wrist band and the hand; and an interior, hand-receiving cavity extending within the display body, the interior cavity having a top, a bottom, and a tapered sidewall extending from the top to the bottom, the bottom exhibiting a diameter greater than a diameter of the top, a hand-receiving entrance into the interior cavity being through the bottom of the wrist band, and the wrist band sidewall including a tapered sidewall, the wrist band bottom exhibiting a diameter greater than a diameter of the wrist band top and forming a base on which the apparatus may rest in an upright position.

23. The apparatus of claim 22 wherein the cavity bottom and the cavity top both exhibit an oval circumference.

* * * * *